United States Patent [19]

Peterson

[11] 4,359,110

[45] Nov. 16, 1982

[54] VARIABLE-LENGTH SAMPLING DEVICE

[76] Inventor: James R. Peterson, Rte. 1, Box 121, Wilton, Calif. 95693

[21] Appl. No.: 189,038

[22] Filed: Sep. 22, 1980

Related U.S. Application Data

[63] Continuation-in-part of Ser. No. 12,735, Feb. 16, 1979, Pat. No. 4,252,200.

[51] Int. Cl.[3] ..... E21B 49/06

[52] U.S. Cl. ..... 175/20; 175/58; 73/864.64

[58] Field of Search ..... 175/20, 58, 77, 276, 175/277, 272, 280, 283, 291, 292, 308, 312; 173/151, 425.2; 385/39, 330; 73/864.64

[56] References Cited

U.S. PATENT DOCUMENTS

| | | | |
|---|---|---|---|
| 855,849 | 6/1907 | Gray | 73/864.64 |
| 1,078,847 | 11/1913 | Grahenfels et al. | 73/864.64 |
| 2,454,952 | 11/1948 | Starkey et al. | 73/151 |
| 2,681,795 | 6/1954 | Gregory | 175/309 |
| 2,688,877 | 9/1954 | Pelne | 73/864.64 |
| 2,896,444 | 7/1959 | Forman et al. | 73/864.64 |
| 3,085,636 | 4/1963 | Bennett et al. | 175/77 |
| 3,091,968 | 6/1963 | Platzer | 73/864.64 |

FOREIGN PATENT DOCUMENTS

| | | | |
|---|---|---|---|
| 458384 | 5/1913 | France | 175/20 |

*Primary Examiner*—James A. Leppink
*Assistant Examiner*—George A. Suchfield
*Attorney, Agent, or Firm*—Watson, Cole, Grindle & Watson

[57] ABSTRACT

A device for obtaining a plurality of samples from mineral deposits such as placer deposits in order to discover the presence of valuable metals comprises an elongated tubular member in which is rotatably positioned an elongated cylindrical storage member, the tubular member including sets of windows along its length and the cylindrical storage member including compartments capable of alignment with the sets of windows upon rotation of the storage member relative to the tubular member. Spring-like tooth members mounted in the compartments are capable of extending through the windows of the tubular member to help the movement of deposit material therethrough. The sampling device may also include one or more extension sections, each extension section including a tubular element in which is rotatably positioned a cylindrical storage element, each respective element being similarly constructed to the noted tubular and cylindrical storage members, all the cylindrical storage elements in the extension sections being positively rotatably interconnected with each other and with the cylindrical storage member.

7 Claims, 10 Drawing Figures

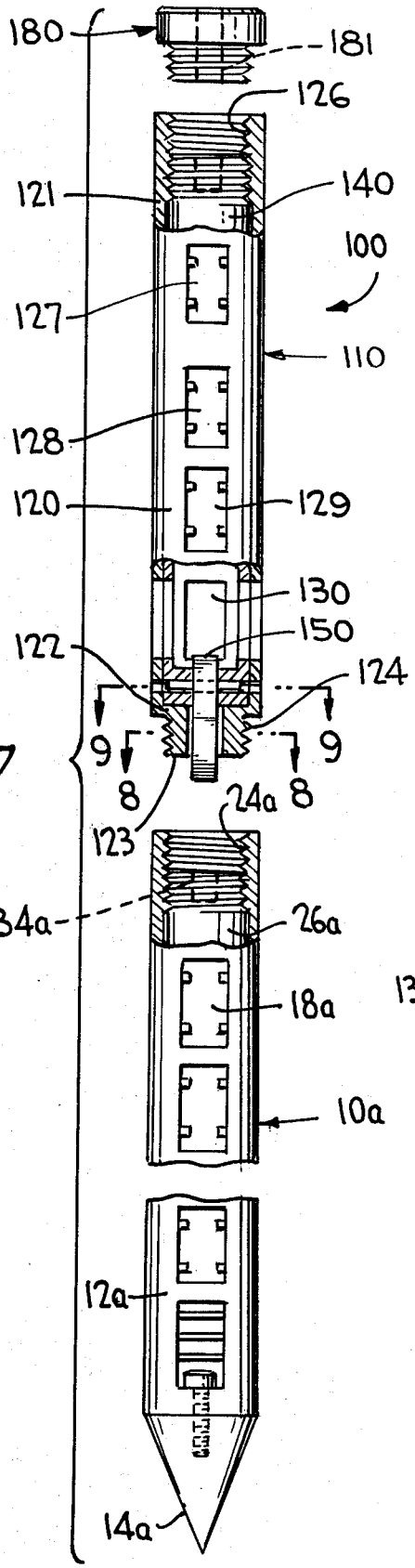
FIG. 7
FIG. 8
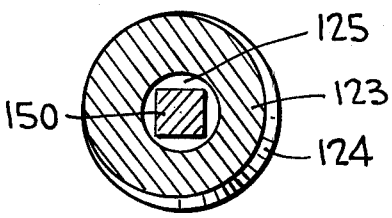
FIG. 9
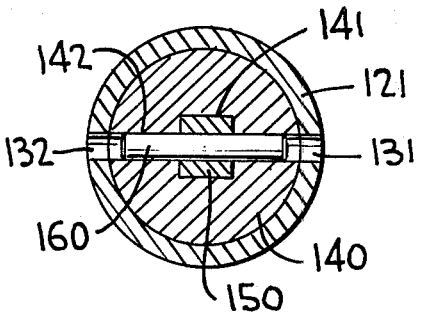
FIG. 10
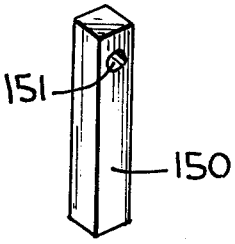

VARIABLE-LENGTH SAMPLING DEVICE

CROSS-REFERENCE TO RELATED APPLICATION

The present application is a continuation-in-part application of application Ser. No. 12,735, filed on Feb. 16, 1979 now U.S. Pat. No. 4,252,200.

BACKGROUND OF THE INVENTION

The present invention is generally directed to devices which are useful in prospecting for minerals, and more specifically to devices which are capable of obtaining samples of placer deposits in order to determine whether or not valuable minerals or metals are contained therein.

Placer deposits which contain various valuable minerals and metals (such as gold) occur in widespread areas throughout various parts of the world. These deposits generally include sand, gravel and other alluvium and eluvium which contain concentrations of minerals or metals of economic importance, and are the result of natural mechanical concentration wherein the heavy, chemically resistant and tough minerals are separated by gravity from the light and friable materials. The most economically important placer deposits generally are those formed by the action of streams where the flow of water creates placer deposits on the inside of meander bends of the stream.

In prospecting for the economically valuable concentrations of minerals or metals within a placer deposit, it has been the general practice to sample the deposit at various spaced apart locations in a uniform grid pattern by one or more methods such as shaft sinking, caisson sinking, churn drilling, open cuts and the like. However, for the amateur or weekend prospector who has limited time, manpower and equipment, these methods for sampling placer deposits are not generally feasible in terms of time and effort. Therefore the need exists for a small and portable yet rugged device for sampling placer deposits which can normally be operated by one person and which can provide accurate and valuable information as to the composition of a particular portion of a deposit.

Devices for obtaining samples of earth are known in the art. For example, U.S. Pat. No. 507,018 to Lacy, U.S. Pat. No. 1,862,339 to Highmark, U.S. Pat. No. 2,454,952 to Starkey, and U.S. Pat. No. 3,036,638 to Parsons disclose such devices. In addition, probe-like devices for obtaining samples of flowable particulate solids such as grain are known from U.S. Pat. Nos. 230,121 to Frost and 1,087,847 to Graunfels, among others. However, none of the above-mentioned patents teach a device having the necessary structure and operation so as to be adapted for use in simultaneously obtaining a plurality of samples from mineral deposits such as placer deposits in a simple and efficient manner.

It is therefore a primary object of the present invention to provide a device adapted for the sampling of placer or other mineral deposits, such a device being portable and easily operated by one person.

A further object of the present invention is to provide a device capable of simultaneously obtaining a plurality of samples from a mineral deposit.

A still further object of the present invention is to provide a device which is capable of simultaneously sampling a deposit at varying depths.

A still further object of the present invention is to provide a sampling device which includes means for dislodging packed material within a placer deposit so as to facilitate recovery of the samples.

A still further object of the present invention is to provide a sampling device which is extendable to an indefinite length such that the device can be used for the taking of placer deposit samples deep down in desert deposits or at the bottom of bodies of water.

SUMMARY OF THE INVENTION

Briefly, in its broader aspects, the present invention comprehends a sampling device adapted for use in obtaining samples of mineral deposits, the device comprising an elongated tubular member which can be pounded into a deposit, the tubular member including a number of sets of opposed windows positioned in spaced apart fashion along its longitudinal length to allow for deposit materials to pass therethrough, and an elongated cylindrical storage member which is rotatably positioned within the tubular member, the cylindrical storage member including a plurality of diametrically-extending compartments located in spaced apart fashion along its longitudinal length which can be aligned with the sets of windows in the tubular member so as to store the deposit materials passing through the windows. Each compartment in the cylindrical storage member has at least one spring-like tooth member mounted therein to extend through a corresponding window in the tubular member when the compartments and windows are aligned so as to aid in the passage of deposit materials through the respective window.

Further objects, advantages and features of the present invention will become more fully apparent from a detailed description of the arrangement and construction of the constituent parts as set forth in the following description taken together with the accompanying drawings.

DESCRIPTION OF THE DRAWINGS

In the drawings,

FIG. 7 shows an exploded side view of the elements forming a sampling device constructed in accordance with another embodiment of the present invention, this device including a bottom section to which one extension section has been attached, FIG. 8 shows a cross-sectional view of the extension section taken along line 8—8 of FIG. 7, FIG. 9 shows a cross-sectional view of the extension section taken along line 9—9 of FIG. 7, and FIG. 10 shows a perspective view of a connection pin used to operatively interconnect the cylindrical storage element of the extension section with the cylindrical storage member of the bottom section in FIG. 7.

DETAILED DESCRIPTION OF THE PREFERRED EMBODIMENTS

Figure 1:
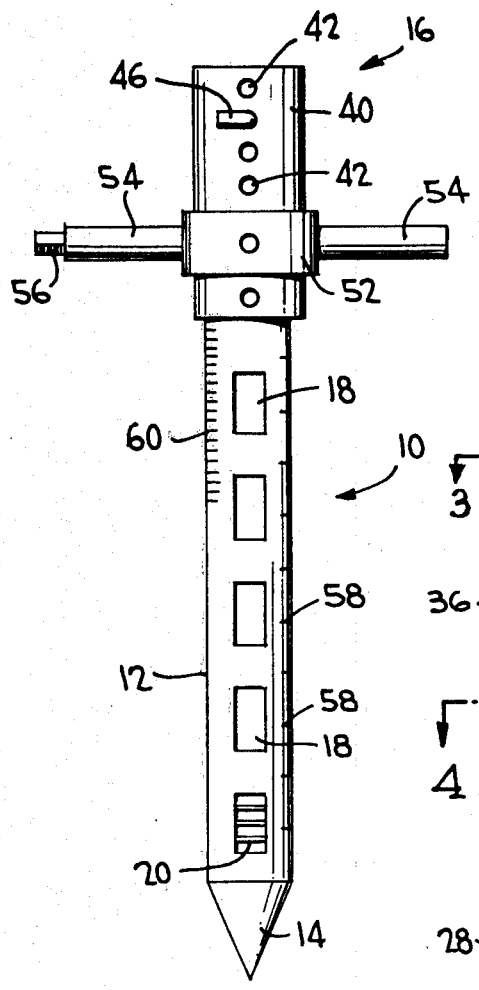
FIG. 1 shows a side view of a sampling device constructed in accordance with one embodiment of the present invention.
Figure 2:
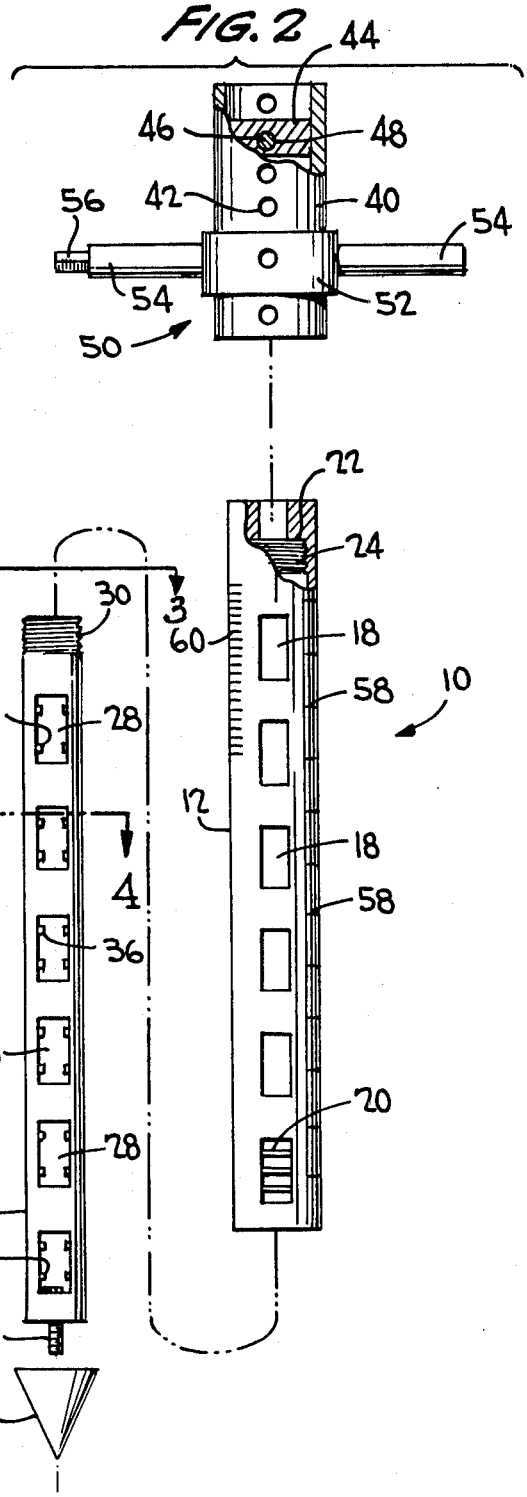
FIG. 2 shows an exploded side view of the device shown in FIG. 1.

Referring first to FIGS. 1 and 2, a sampling device 10 is shown which is constructed in accordance with one embodiment of the present invention. This device can be seen to comprise an elongated tubular member 12, an elongated cylindrical storage member 26, and a pointed conical member 14. A pounder 16 can also be used as part of the sampling device. The elongated cylindrical storage member 26 coaxially fits within the tubular member 12, the pointed conical member 14 is attached to the lower end of the cylindrical storage member 26, and the pounder 16, when used, is positionable on the upper end of the tubular member 12.

As best seen in FIG. 2, the elongated tubular member 12 is formed by a tubular wall 13 which includes an inwardly projecting circumferential lip 22 at its upper end and internal threads 24 which extend a small distance inwardly along the length of the tubular wall 13 from the lip 22. The tubular wall 13 also has a number of sets of opposed, rectangularly-shaped windows 18 formed therein along its longitudinal length, each window set being preferably equally spaced from the adjacent window set along the length of the tubular wall 13. Each window of each window set optionally includes one or more curved bars 20 extending thereacross in a circumferential fashion with respect to the tubular wall 13 as is shown for the window in the lowermost window set in FIG. 1.

Figure 3:
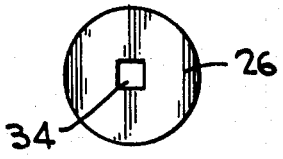
FIG. 3 shows a top view of the cylindrical storage member of the sampling device shown in FIG. 2, i.e., as seen along line 3—3.
Figure 4:
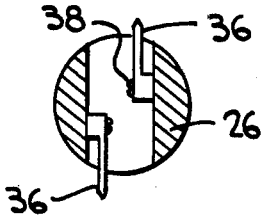
FIG. 4 shows a cross-sectional view of the cylindrical storage member of the sampling device shaft taken along line 4—4 of FIG. 2.
Figure 5:
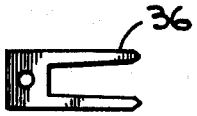
FIG. 5 shows a detailed side view of one of the tooth members shown in FIG. 4.

Positioned within the tubular member 12 so as to be rotatable with respect thereto is an elongated cylindrical storage member 26. This cylindrical storage member is seen to include a series of diametrically-extending compartments 28 located in spaced apart fashion along its longitudinal length, these compartments being located therein to correspond in number, shape, size and location with the window sets in the tubular member 12, such that when the cylindrical storage member 26 is suitably rotatably oriented within the tubular member 12, all the compartments therein will be aligned with windows 18 in the tubular member. As is best shown in FIG. 4, each compartment 28 extends completely through the cylindrical storage member 26. The upper end of the cylindrical storage member 28 is provided with external threads 30 which are adapted to engage with the internal threads 24 of the tubular member 12. At the opposite end of the cylindrical storage member a cylindrical bore (not labeled) is provided which extends from the floor of the lowermost compartment in the cylindrical storage member to the lower end thereof in which a bolt 32 is positioned, this bolt 32 engaging a threaded hole (not shown) within conical member 14 so as to securely attach the conical member to the lower end of the cylindrical storage member 26. As is shown in FIG. 3, the upper end of the cylindrical storage member 26 is also provided with a blind axial indentation 34, which in this embodiment is rectangular in cross-section, the indentation having a depth sufficient to accomodate a suitable tool.

As is apparent, when device 10 is assembled, the cylindrical storage member 26 will fit closely within the tubular wall 13 of the outer tubular member 12, and when threads 24 and 30 are almost fully engaged, each compartment 28 will be aligned with the windows 18 of a window set in the tubular wall 13. Upon rotation of the cylindrical storage member 26 relative to the tubular member 12 of about one-quarter turn, compartments 28 in the shaft will become closed by the tubular wall 13 of the tubular member 12.

As is best shown in FIG. 4, each compartment 28 of cylindrical storage member 26 has mounted therein one or more spring-like tooth members 36 adapted to extend from each side of the compartment. Each tooth member 36 is attached to the inner wall of compartment 28 by a fastener 38 such as a screw, bolt or the like. The tooth members 36 which extend from opposite ends of compartment 28 must be located on opposite side walls forming each compartment so that when the cylindrical storage member 26 is rotated (e.g., clockwise with the FIG. 4 embodiment) relative to the tubular member 12 to close the compartments, the ends of each tooth member 36 will be forced inwardly into the respective compartment.

Pounder 16, which is adapted to fit over the upper end of the tubular member 12, includes a hollow cylindrical portion 40 having an internal diameter approximating the external diameter of the tubular member 12. Cylindrical portion 40 also has a plurality of holes 42 on each side which extend along its longitudinal axis. Disc-shaped adjustable weight 44 of a diameter approximating the internal diameter of cylindrical portion 40 is located within the cylindrical portion and is held in that position by L-shaped pin 46 passing through a pair of holes 42 and a bore 48 in the weight. Fixedly attached to the external surface of cylindrical portion 40 is a handle 50 comprising ring portion 52 and extending arm portions 54. Handle 50 may be attached to cylindrical portion 40 by welding or the like. The end of one of arm portions 54 is formed into rectangularly-shaped tool 56 of a size sufficient to snugly fit within the blind axial indentation 34 in the upper end of the cylindrical storage member 26.

Preferably, the tubular member 12, the conical member 14, the pounder 16 and the cylindrical storage member 26 of sampling device 10 are made of high strength steels and they will have dimensions sufficient to withstand pounding forces. Tooth members 36, on the other hand, are made of resilient materials such as high strength polymers or tempered steels. The overall length of device 10 as shown in FIGS. 1 and 2 will be about 3 to 7 feet, this length being satisfactory for sampling of most placer deposits. Although the diameter of the device is not critical, the smaller the diameter, the easier it is to force the device into a placer deposit.

To utilize device 10 so as to obtain a plurality of samples from a deposit, the device is assembled as shown in FIG. 1, with weight 44 of pounder 16 resting on the top surface of the tubular member 12 and with the cylindrical storage member 26 oriented therewithin such that compartments 28 are closed by the tubular wall 13 of the tubular member 12. (It should be noted that when external threads 30 of the cylindrical storage member 26 are screwed tightly into internal threads 24 of the outer tubular member 12, compartments 28 will be closed, the top of the inner cylindrical shaft will be in engagement with lip 22 of the outer tubular member, and the bottom of the outer tubular member will be brought tightly against pointed member 14. Thus, threads 24 and 30 will not be subjected to shock and pressure as device 10 is driven into a deposit.)

Conical member 14 of device 10 is then placed on the surface of the deposit to be sampled and the device forced into the deposit by striking repeated blows against the exposed or upper end of the tubular member 12 with a sledge-hammer, or preferably with pounder 16. As device 10 progresses into the deposit by use of pounder 16, it may be advantageous to occasionally remove the pounder and change the location of the weight 44 within the cylindrical portion 40 by removing pin 46 and having it pass through another pair of holes 42 so as to maintain handle 50 of pounder 16 at a convenient height from the surface of the deposit. Since handle 50 of pounder 16 is preferably mounted near one end of cylindrical portion 40, the pounder can also be inverted relative to the tubular member 12 to provide further height adjustment for the handle of the pounder relative to the end of the tubular member 12. Clearly, pounder 16 could be made of a greater length relative to the tubular member 12 than that shown in the drawings if more height adjustment of the pounder was considered to be desirable.

Once device 10 has been driven to the desired depth by use of pounder 16, the pounder is removed and a tool such as an extended ratchet-type wrench or tool 56 on arm portion 54 of the pounder is inserted through the upper end of the tubular member 12 to engage with the blind indentation 34 in the upper end of the cylindrical storage member 26. Upon appropriate rotation of the cylindrical storage member 26 by the tool, the compartments 28 thereof will become aligned with the windows in the tubular member and consequently the tooth members 36 will be allowed to project therethrough and into the surrounding deposit. The material of the deposit adjacent to the window and the compartment 28, being primarily sand or gravel, will then tend to flow into the compartments, especially as a result of loosening thereof by the tooth members 36. Striking device 10 with several blows while windows 18 are aligned with compartments 28 may also help to collect a sample of sufficient volume. Bars 20 across each window 18, when used, can help prevent larger rocks or minerals from partially entering compartments 28 and blocking further rotation of the cylindrical storage member 26 relative to the tubular member 12.

After the samples have been collected in each of compartments 28, tool 56 or the like is again used to rotate the cylindrical storage member 26 and thereby close compartments 28 to retain the collected samples. The cylindrical storage member 26 must be rotated in a direction opposite to that used to open compartments 28 so that tooth members 36 will be inwardly biased and thereby caused to retract within the compartments.

Before removing device 10 from the deposit, the depth of insertion of the device should be recorded by noting which of the depth indicator marks 58 on the side of the tubular member 12 is closer to the surface of the deposit.

Figure 6:
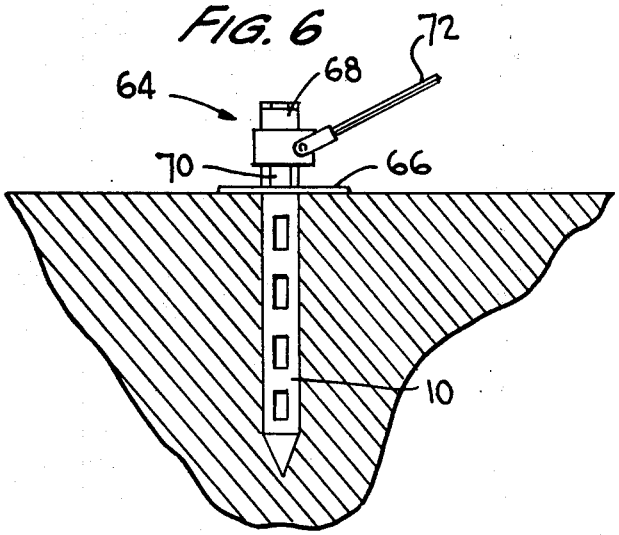
FIG. 6 illustrates a jack-type apparatus which can be used for removing the sampling device of FIG. 1 from a deposit.

Device 10 with pounder 16 removed is then extracted from the deposit, preferably by automobile bumper jack-type apparatus 64 as shown in FIG. 6. Jack apparatus 64 sequentially engages notches 60 on the side surface of tubular member 12 and thereby lifts device 10 from the deposit. Apparatus 64 includes base 66 of sufficient area, preferably of 10–12 inches in diameter, so that the apparatus will not tend to sink when used on sand or other soft surfaces. Support members 70 attached to base 66 elevate the jacking mechanism of apparatus 64 from the deposit surface to provide sufficient space for the operation of the apparatus.

The specific jacking mechanism of apparatus 64 contained in member 68 surrounding device 10 is not shown in detail as many suitable mechanisms are available in the marketplace and such can be adapted for use with an apparatus without significant modifications. For convenience and also to reduce the overall weight and bulk in transporting device 10 and associated jack apparatus 64, arm portions 54 of handle 50 of pounder 16 may be used as the operating lever for the jack apparatus in lieu of the removable bar 72 shown in the drawing.

Upon removal of device 10 from the deposit by apparatus 64 or the like, tool 56 is again utilized to open compartments 28 and the various samples obtained are then analyzed for the presence of valuable minerals by methods such as panning or the like. If valuable concentrations of minerals have been found in the samples, further investigation by conventional prospecting methods are then utilized. If, however, the samples prove to be negative, a new location in the deposit is selected and the operation of the device is then repeated.

Thus, a sampling device according to the first embodiment of the present invention provides a simple and efficient means for a prospector to sample placer deposits for the presence of valuable concentrations of minerals. The device is portable, it can be easily operated by one person, and it provides valuable information, not only as to the presence of minerals, but also the depth at which these minerals are located in the deposit.

Referring now to FIG. 7, a sampling device 100 is shown (in exploded view) which is constructed in accordance with another embodiment of the present invention. This device can be seen to comprise an elongated bottom section **10*a*, an elongated extension section 110, and a cap 180**.

The elongated bottom section **10*a* includes a tubular member 12*a*, a cylindrical storage member 26*a*, and a conical member 14*a*, each of these elements corresponding to the elements 10, 26 and 14 shown in FIG. 2. However, the upper end of the tubular wall of the tubular member 12*a*, instead of including an inwardly projecting circumferential lip 22, has the inner threads 24*a*** extending from a point inwardly along its length all the way to the upper end thereof.

The elongated extension section 110 itself includes a tubular element 120 and a cylindrical storage element 140, the cylindrical storage element 140 being rotatable within the tubular element 120. The tubular element 120 is formed by a tubular wall 121, which as a diameter equal to that of the tubular member **12*a*, and an integral floor portion 122 at its lower end that includes a cylindrical extension flanges 123 projecting away therefrom, this cylindrical extension flange 123 having external threads 124 thereon which are engageable with the internal threads 24*a* at the upper end of the tubular member 12*a*. A cylindrical hole 125 (see FIG. 8) extends through the floor portion 122 axially with respect to the tubular wall 121, the diameter of this hole being larger than the largest dimension of the rectangular indentation 34*a* in the upper end of the cylindrical storage member 26*a* of the bottom section 10*a*. The upper end of the tubular wall 121 includes internal threads 126. The tubular wall 121 also includes along its longitudinal length a number of sets of windows, shown in FIG. 7 as window sets 127, 128, 129 and 130. The upper three sets of windows 127, 128 and 129 include two rectangularly-shaped windows located on opposite sides of the tubular wall 121, whereas the lowermost set of windows 130 includes four equally circumferentially spaced apart rectangularly-shaped windows, two of which are aligned with the windows in sets 127–129 in the longitudinal direction of the tubular wall 121. Located on opposite sides of the tubular wall 121 between the floor portion 122 and the bottom of the windows in the lowermost window set 130 are circular openings 131 and 132 (see FIG. 9**).

The cylindrical storage element 140 is constructed very similarly to the cylindrical storage member 26*a*, i.e., it includes diametrically-extending compartments along its longitudinal length which can be aligned with the window sets 127–130 in the tubular element 120 when properly rotated, etc. However, as indicated in FIG. 9, the cylindrical storage element 140 will also include an axially-extending channel 141 journalled therein to extend from the center of the bottom of the lowermost chamber to the lower end, this channel having a rectangular cross section which corresponds in size and shape with the dimensions of the rectangular indentation 34*a* in the upper end of the cylindrical storage member 26*a*, the cylindrical storage element also including a diametrically-extending cylindrical bore 142 journalled therein to communicate with the channel 141, the outer ends of the bore 142 being registerable with the circular openings 130 and 131 in the tubular element 120.

Once the extension section 110 has been firmly connected to the bottom section 10*a* by the threaded connection between the external threads 124 or the extension flange 123 of the tubular element 120 with the inner threads 24*a* of the tubular member 12*a*, and after the cylindrical storage element 140 has been rotatably positioned within tubular element 120 such that the rectangular dimensions of channel 141 are aligned with the rectangular dimensions of the channel 34*a* in the upper end of the cylindrical storage member 36*a* (note that at this point not only will bore 142 be aligned with openings 130 and 131, but the three upper compartments in the cylindrical storage element 140 will be 90° out of register with the windows of window sets 127–129 in the tubular element 120, whereas the lowermost compartment in the cylindrical storage element 140 will be in register with two opposed windows of the lowermost window set 130 in the tubular element 120), a connection pin 150 (see FIG. 10) having a rectangular cross section and a hole 151 therethrough near its upper end can be inserted into the lowermost compartment of the cylindrical storage element and inserted through the channel 141 and the cylindrical hole 125, and then snugly positioned within the indentation 34*a* in the upper end of the cylindrical storage member 26*a* to thereby interlock the rotational positions of the cylindrical storage element 140 with the cylindrical storage member 26*a*. A cylindrical locking pin 160 of a suitable diameter (see FIG. 9) can then be inserted through either of openings 130 and 131 and along bore 142 to extend through the hole 151 in the connection pin 150 to lock the connection pin 150 in position. Since the length of the locking pin 160 will be less than the diameter of the cylindrical storage element 140, and since the connection pin 150 will have smaller cross sectional dimensions than the diameter of the cylindrical hole 125 in the floor portion 122 of the tubular element 120, the interconnected cylindrical storage element 140 and cylindrical storage member 26*a* will be simultaneously freely rotatable within tubular element 120 and tubular member 12*a*.

The upper end of the extension section 110 can either be similarly connected to another identical extension section (depending on the overall desired length for the sampling device) or else, as shown in FIG. 7, covered by a cap 180 which can be threadingly connected thereto and which includes a cylindrical hole 181 extending axially therethrough that has the same diameter as the cylindrical hole 125 in the floor portion 122 of the tubular element 120.

A pounder, such as the pounder 40 shown in FIGS. 1 and 2, can be used in conjunction with the device shown in FIG. 7 similarly to the fashion it is used with the sampling device of FIGS. 1 and 2 to provide an operable sampling device.

Due to the positive rotational interconnection of the cylindrical storage elements 140 in each of the utilized extension sections to the cylindrical storage members 26*a* in the bottom section 10*a*, all of these structures will rotate in unison when the uppermost cylindrical element is rotated, such as by the use of a tool 56 on pounder 40, while the tubular elements 120 of all the extension sections, as well as the tubular member 12*a* of the bottom section 10*a*, will remain stationary. The sampling device is thus capable of extension to indefinite lengths.

The connection pins 150 can be inserted and/or removed from interconnection between the various sections of the sampling device by access to the lowermost compartment in each cylindrical storage element 140 via one of the four windows in the lowermost window set 130. Thus, access is provided whether or not the upper compartments in each cylindrical storage element are aligned with the windows of the upper window sets.

While two embodiments of the present invention have been described, it will be understood that numerous modifications may be made by those skilled in the art without actually departing from the spirit and scope of the invention as defined in the appended claims.

I claim:

1. A variable-length sampling device capable of obtaining a plurality of samples from a mineral deposit, said variable-length sampling device comprising a bottom section which includes an elongated tubular member, an elongated cylindrical storage member rotatably positioned within said elongated tubular member, and a pointed conical member attached to the lower end of the cylindrical storage member; said elongated tubular member including a tubular wall having a plurality of window sets which are spaced apart along the length thereof; said elongated cylindrical storage member having a plurality of diametrically-extending compartments which are spaced apart along the length thereof which are registerable with the window sets in said tubular member, each compartment including a spring-like tooth member which is capable of extending through a corresponding window in said tubular member when aligned therewith, said elongated cylindrical storage member also including a blind indentation in the upper end, an extension section which includes an elongated tubular element and an elongated cylindrical storage element rotatably positioned with said elongated tubular element; said elongated tubular element including a tubular wall having a plurality of window sets which are spaced apart along the length thereof and an integral floor portion at the lower end thereof, said floor portion including an extension flange capable of attachment to the upper end of said tubular member and a cylindrical hole extending axially therethrough with respect to said tubular wall, said cylindrical hole having a larger diameter than the largest dimension of said indentation in the upper end of said cylindrical storage member; said elongated cylindrical storage element having a plurality of diametrically-extending compartments which are spaced apart along the length thereof which are registerable with the window sets in said tubular element, each compartment including a spring-like tooth member which is capable of extending through a corresponding window in said tubular element when aligned therewith, said elongated cylindrical storage element also including a blind indentation in the upper end identical in size and shape to said indentation in the upper-end of said cylindrical storage member, as well as an axial bore extending from the lowermost compartment to the lower end thereof, said bore having a cross section equal in size and shape to said indentation in the upper end of said cylindrical storage member, and a connection pin which is positionable to extend through said bore in said cylindrical storage element and said cylindrical hole in said tubular element to fit within said indentation in the upper end of said cylindrical storage member, said connection pin having a cross section of similar size and identical shape to the indentation in the upper end of said cylindrical storage member so as to positively interconnect the cylindrical storage element with said cylindrical storage member.

2. The variable-length sampling device as claimed in claim 1, wherein the upper end of said tubular member includes internal threads and wherein the upper end of said cylindrical storage member includes external threads, said external threads of said cylindrical storage member being engageable with said internal threads of said tubular member.

3. The variable-length sampling device as claimed in claim 2 wherein the upper end of said tubular element includes internal threads and wherein the upper end of said cylindrical storage element includes external threads, said external threads of said cylindrical storage element being engageable with said internal threads of said tubular element.

4. The variable-length sampling device as claimed in claim 3 wherein a cap means having an axially-extending cylindrical bore is connected to the upper end of said tubular element.

5. The variable-length sampling device as claimed in claim 3 wherein at least one additional extension section is attached to the upper end of said extension section.

6. The variable-length sampling device as claimed in claim 3 wherein at least some of the windows in both said tubular member and said tubular element include curved bars extending thereacross in circumferential fashion.

7. The variable-length sampling device as claimed in claim 3 wherein the lower end of said tubular element of said extension section includes circular openings in opposite sides thereof between said floor portion and the lowermost compartment, wherein said cylindrical storage element of said extension section includes a diametrically-extending cylindrical bore which communicates with said axially-extending channel therein and the opposite ends of which are registerable with said circular openings in said tubular element, wherein said connection pin includes a hole therethrough, and wherein a cylindrical locking pin having a length less than the diameter of said cylindrical storage element extends through said diametrically extending cylindrical bore in said cylindrical storage element and through said hole in said connection pin.

* * * * *